United States Patent [19]

Tompkins et al.

[11] 4,038,625

[45] July 26, 1977

[54] MAGNETIC INDUCTIVELY-COUPLED CONNECTOR

[75] Inventors: Russell E. Tompkins, Scotia, N.Y.; Franklin A. Fisher, Pittsfield, Mass.; Robert P. Wanger, Fairfield, Ohio

[73] Assignee: General Electric Company, Schenectady, N.Y.

[21] Appl. No.: 693,298

[22] Filed: June 7, 1976

[51] Int. Cl.[2] ..... H01F 15/02

[52] U.S. Cl. ..... 336/83; 336/84; 336/DIG. 2

[58] Field of Search ..... 336/DIG. 2, 83, 212, 336/84

[56] References Cited

U.S. PATENT DOCUMENTS

| | | | |
|---|---|---|---|
| 2,379,664 | 7/1945 | Stanko | 336/DIG. 2 |
| 2,967,267 | 1/1961 | Steinman et al. | 336/DIG. 2 |
| 3,292,579 | 12/1966 | Buchanan | 336/DIG. 2 |
| 3,387,606 | 6/1968 | Crafts et al. | 336/DIG. 2 |

FOREIGN PATENT DOCUMENTS

| | | | |
|---|---|---|---|
| 1,398,224 | 6/1975 | United Kingdom | 336/DIG. 2 |
| 1,366,134 | 9/1974 | United Kingdom | 336/DIG. 2 |

*Primary Examiner*—Thomas J. Kozma
*Attorney, Agent, or Firm*—Donald R. Campbell; Joseph T. Cohen; Jerome C. Squillaro

[57] ABSTRACT

An electrical connector for applications where reliability and safety are needed uses transformer couplings made in two separable sections. Upon clamping together the surrounding metal housing halves, each inductively coupled pair of transformer windings is enclosed by the associated cup-type ferrite magnetic core to minimize undesired interference and result in good magnetic coupling.

2 Claims, 6 Drawing Figures

MAGNETIC INDUCTIVELY-COUPLED CONNECTOR

BACKGROUND OF THE INVENTION

This invention relates to an inductively-coupled electrical connector, and more particularly to an inductive connector using transformer couplings with cup-type ferrite magnetic cores.

There is a need for a more reliable electrical connector in an aircraft engine control system and other applications where reliability and safety are important criteria. At present it is conventional to use pin and socket connectors. However, in the very adverse, high temperature environment of the engine interface with the aircraft, connectors which depend on mechanical contact for electrical signal coupling lead to reliability problems as a result of variable contact resistance, misalignment, sealing, fragility, and deterioration due to electrolysis. Other industries where an improved connector is needed are medical electronics and food processing as well as chemical and military applications where reliability is a safety precaution. The present invention is directed to a versatile and easily manufactured inductive connector that does not depend on mechanical contacting members to transfer the electrical signal, but rather magnetic flux which will bridge an air gap.

SUMMARY OF THE INVENTION

In accordance with the invention, a reliable and improved inductive connector as broadly defined comprises at least one transformer coupling made in two separable sections which, when clamped together, include a magnetic core structure that substantially encloses the pair of inductively coupled transformer windings. A pair of mating conductive housing units protect and support the coupling sections while functioning as a shield for electromagnetic interference. Upon releasably clamping together the housing units, the transformer coupling sections are aligned with a small air gap between the two sections.

The preferred embodiment of the magnetic inductive connector incorporates a plurality of transformer couplings that can be closely spaced in view of the shielding provided by the magnetic core geometry for undesired cross talk and electromagnetic interference (EMI). The ferrite magnetic core is composed of two substantially identical, one-piece, opposing cup-type core halves each including a center member about which one transformer winding is disposed and also on outer member, the core halves when assembled having a magnetic air gap therebetween with the two transformer windings and center members collinear and magnetically coupled. The housing can be a conventional circular metal shell with a rotatable screw-threaded ring, each housing unit further having a metallic support plate with recesses in which the transformer coupling sections are received. A protective covering ordinarily is applied over exposed surfaces of the transformer coupling sections at the air gap interface. As has been mentioned, there are many applications for the inductive connector where reliability and/or safety are prerequisites, and a high frequency, high temperature connector for aircraft jet engine controls is described in detail.

DESCRIPTION OF THE PREFERRED EMBODIMENTS

Figure 1:
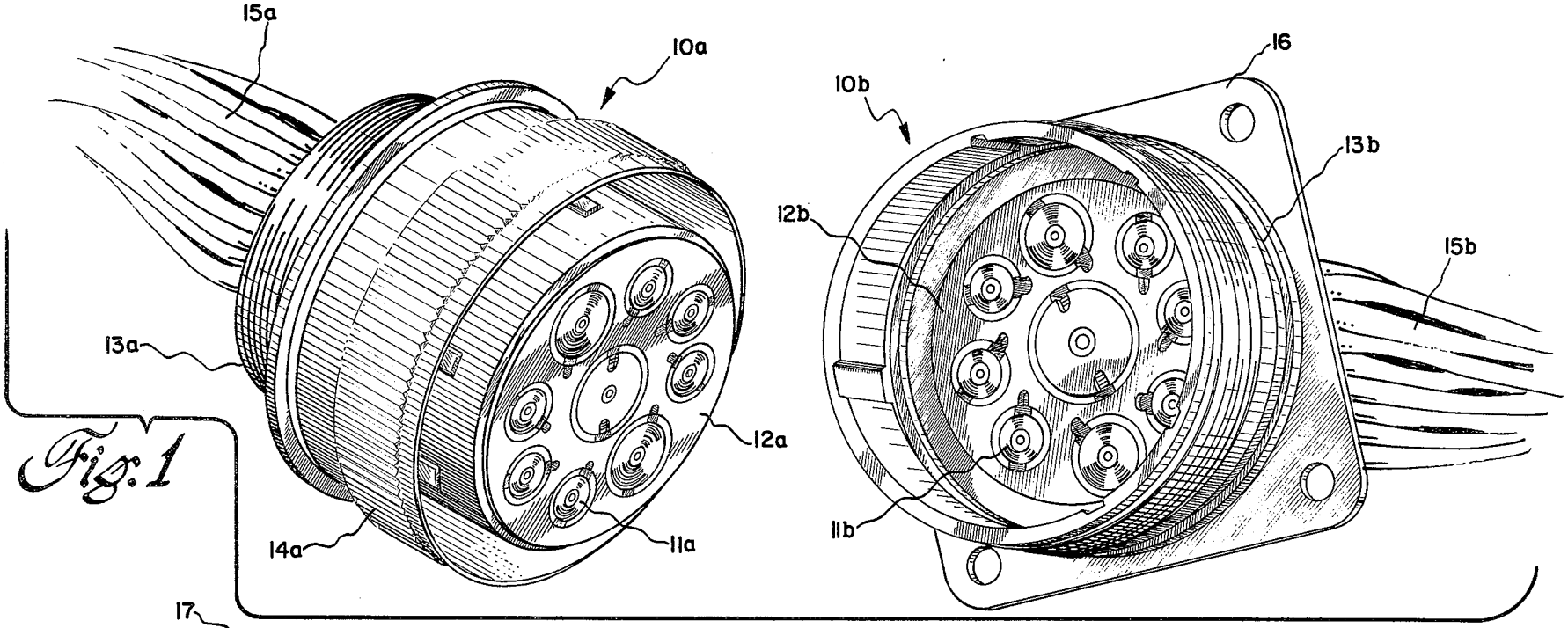
FIG. 1 is a perspective view of the two separated parts of a magnetic inductively-coupled connector constructed according to the teaching of the invention.

The plug and receptacle connector parts 10*a* and 10*b* of a preferred form of the magnetic inductor connector are illustrated in FIG. 1 with the mating parts separated from one another. The principal components of the inductive connector are a pluality of two-section transformer couplings, each having one section 11*a* associated with the plug part 10*a* while the other section 11*b* is associated with the receptacle part 10*b*. Nine such matched pairs making up nine individual inductively-coupled connectors are illustrated in various sizes depending upon the application and set of requirements. The set of transformer coupling sections 11*a* are received in recesses in a metallic support plate 12*a*, and similarly, support plate 12*b* has a plurality of recesses arranged in the same pattern in which are received transformer sections 11*b*.

The two transformer section and support plate assemblies are respectively mounted within a pair of mating housing units 13*a* and 13 *b* which are made to provide a shield for external electromagnetic interference (EMI) and are capable of clamping the two assemblies together in alignment with only a small air gap between the matched pairs of transformer coupling sections. Thus, a variety of metal or conductive housing configurations can be employed in the practice of the invention. The housing units here depicted can be described as solid shells for standard circular connectors, and are commonly used for conventional prior art pin and socket connectors and sold by a number of manufacturers including the Amphenol Sales Division of Bunker Ramo Corp., Broadview, Illinois. The plug part housing unit 13*a* has a rotatable ring 14*a* with internal screw threads that are engagable with external screw threads on housing unit 13*b*. Further, proper angular orientation of the two housing units as they are clamped together is assured by keys on the insert of plug part 10*a* and mating keyways on the inside surface of receptacle part housing unit 13*b*. The internal details of plug and receptacle parts 10*a* and 10*b* are not illustrated but are evident to those skilled in the art. Of course, wires 15*a* entering the plug part are effectively connected to the coil terminal wires of transformer sections 11*a*, while the transformer coils in coupling sections 11*b* are effectively connected with wires 15*b* entering the receptacle part 10*b*, which has a mounting flange 16.

Figure 3:
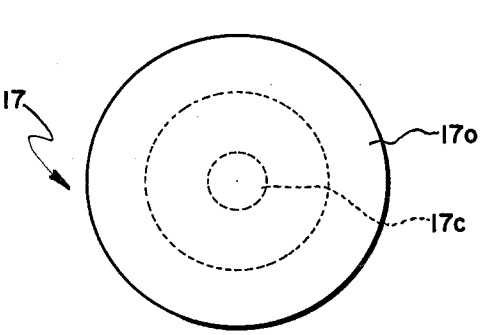
FIG. 3 is a top view of the transformer core shown in FIG. 2.
Figure 2:
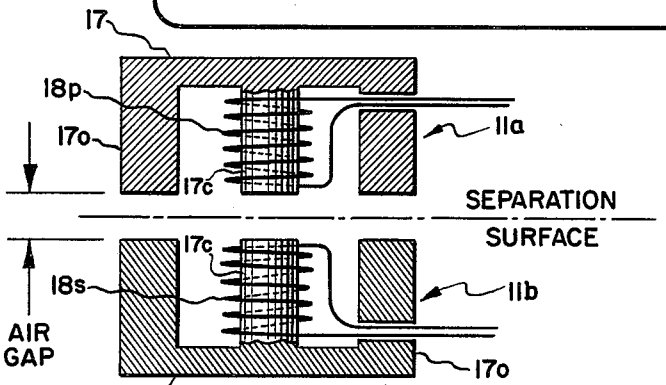
FIG. 2 is a vertical cross sectional view through a single transformer coupling and its ferrite cup core, with the sections aligned but spaced apart to show the separation surface.

FIGS. 2 and 3 are cross-sectional and top views of a single transformer coupling with identical, separable transformer sections 11*a* and 11*b*. In FIG. 2 the distance between the opposing sections is emphasized to clearly indicate the magnetic air gap and planar separation surfaces. The magnetic core structure is made of magnetic material, ferrite in this embodiment, and the two core halves are one-piece, cup cores or pot cores 17, both having a solid center member 17*c* and a cup-shaped outer member 17*o*. Center member 17*c* has a circular cross section while the wall section of outer member 17*o* is cylindrical, thereby defining an annular window space for receiving the primary transformer winding 18*p* or secondary transformer winding 18*s*. A cross section of a core is of a general E shape. Assuming that opposing transformer sections 11*a* and 11*b* are assembled together with a minimum air gap, it is seen that transformer windings 18*p* and 18*s* and center members 17*c* are substantially collinear and magnetically coupled together. Further, the windings and center members are substantially enclosed by other core members 17*o*, with the exception that there is a small hole or slot in each core half for passage of the transformer coil terminal wires.

Figure 4:
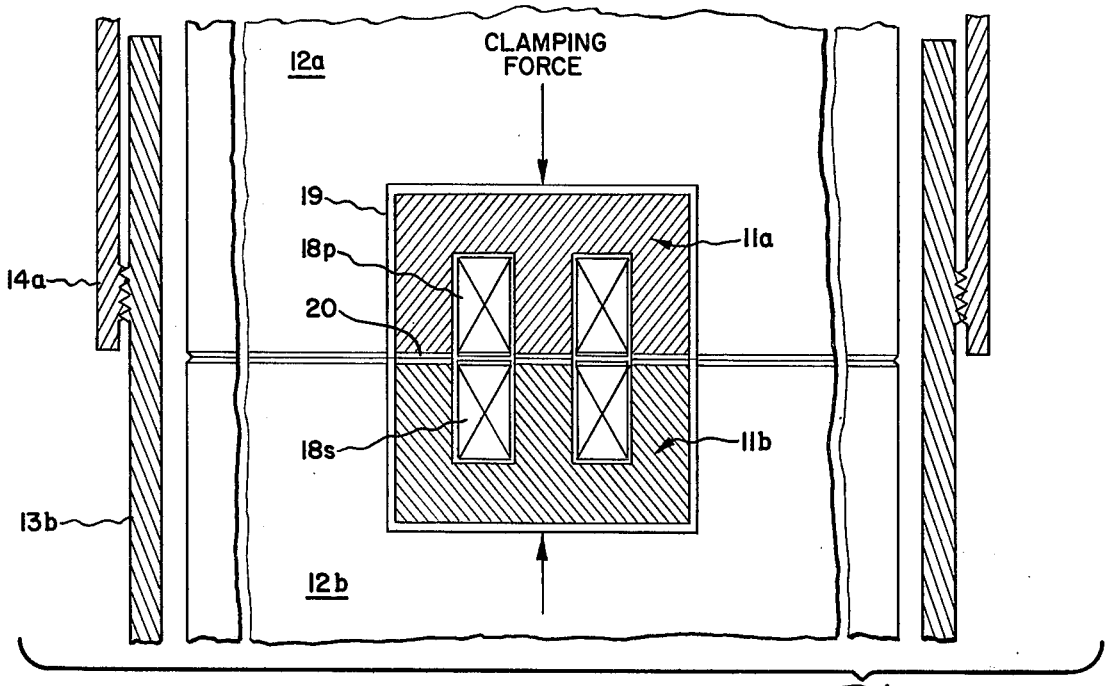
FIG. 4 is a diagrammatic, partially broken-away vertical cross section through the assembled inductive connector showing a single transformer coupling and the surrounding metal shell for clamping together the two connector parts.

Although the magnetic inductive connector ordinarily includes a plurality of transformer couplings, FIG. 4 shows a single two-section transformer according to the invention as more broadly defined. Support plates 12*a* and 12*b* typically are made of aluminum and have opposing recesses 19 in which are received a transformer coupling section 11*a* or 11*b*. The two connector parts inserts, it is observed, are identical to one another when the primary and secondary transformer windings 18*p* and 18*s* have the same number of turns. Of course, the turns ratio can be other than unity depending upon the application. It is desirable in view of the adverse environment and mechanical abuse to which the inductive connector may be subjected to apply a protective coating 20 at least to exposed areas of the magnetic core halves and transformer windings. Alernatively, each core half and winding assembly can be individually dip coated, or the entire surface of the respective support plates 12*a* and 12*b* with their assembled transformer sections can be coated. Exposure to things such as salt air, oily films, moisture, and mechanical abuse would endanger the cores and coils if they were not adequately protected. Since protective coating 20 is applied to the core pieces of aligned core center members 17*c*, the thickness of these coatings in effect determines the magnetic air gap of the core structure. It has been determined that an air gap of less than about 5 mils is acceptable. The cores have ground interface surfaces for minimum air gap.

The preferred form of transformer couplings with opposing cup-type core halves and collinear windings, when the two sections are assembled together, have the advantage of providing a good magnetic coupling for transfer of electrical signals and of supplying their own shield for electromagnetic interference and cross talk by their design geometry. Magnetic flux carried by core center members 17*c* splits left and right in core outer members 17*c* so that the main flux paths are confined with the exception of the small air gap. This transformer configuration has an average impedance but, as was mentioned, has a flat separation surface. Considered as a transformer, this configuration has a good coefficient of coupling, on the order of 0.9. Due to the manner in which the magnetic field is well confined within the core there is a minimal amount of magnetic flux to couple to adjacent transformers. This same confinement of the magnetic fields makes the transformers insensitive to magnetic fields of external origin. The metal support plate within which the cores are recessed further serves to confine any leakage magnetic field to the immediate vicinity of the core and further reduces the sensitivity to cross talk and interference from externally induced EMI. Accordingly, adjacent transformer couplings can be closely spaced and the density of connectors is favorable as compared to conventional pin and socket connectors. Rejection of common mode interference is an inherent virtue of this type of coupling, one that is not provided by conventional pin and socket couplings. The transformers provide the desired magnetic coupling only for signals developed between the two conductors of a conductor pair. Interference signals existing in a line-to-ground or common mode are only very weakly coupled across the air gap.

Figure 5:
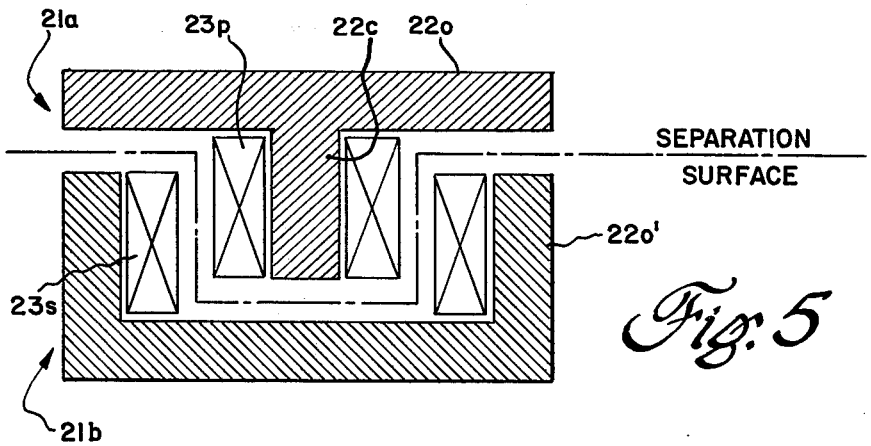
FIG. 5 is a vertical cross section through a modification of the two-section transformer coupling using another type of ferrite cup core.

Another suitable transformer configuration for use in magnetic inductive connectors is given in FIG. 5. This transformer coupling utilizes a modified "E" core or cup-shaped core in which the primary and secondary windings are nearly coaxial. When the two transformer coupling sections 21*a* and 21*b* are assembled together, the magnetic core structure is similar to that in FIG. 2 in that the center member and transformer windings are substantially enclosed. In this magnetic core geometry, one-piece cylindrical center member 22*c* is integral with the circular flat end section of outer member 22*o*. The other cup-shaped outer member 22*o'* associated with transformer section 21*b* includes the entire cylindrical wall section which is integral with the other circular flat end section. One transformer winding, such as primary winding 23*p*, is disposed about center member 22*c* and the secondary winding 23*s* is mounted adjacent the cylindrical wall section of the core. Advantages of this transformer coupling geometry are the confined main flux paths, insensitivity to cross talk and EMI, and low transformer impedance. On the other hand, the core diameter is larger and there is a non-flat separation surface that provides a trap for foreign material and is not easy to keep clean. The protective covering for the pole pieces and coils can be in the form of an insulated sheet moled in the shape of a muffin or cookie pan.

Two other types of magnetic core geometries that are rejected for use in two-section transformer couplings for magnetic inductive connectors will be mentioned. A simple two-section bar core, with the primary winding wound about one section and the secondary winding wound about the other section and with the core sections and transformer windings collinear when assembled together, is the simplest configuration and most conservative of panel space. It also has a flat separation surface and is insensitive to gap spacing. It is rejected, however, because its uncontrolled main flux path makes it inherently susceptible to cross talk from adjacent transformers and EMI to and from adjacent circuits. A second unsuitable magnetic core structure for this application is made up of two abutting "U" or "C" cores with the windings wound about the middle section of each core so that they are parallel to one another when the two separable transformer sections are assembled together. This type of core provides the potential for being manufactured in a space saving rectangular configuration having a flat separation surface. In such a core the main flux path is more controlled than in the aforementioned collinear bar core, but less well controlled than the cup-core depicted in FIG. 2. It would have a higher, and probably unacceptable, sensitivity to EMI an cross-talk. Its impedance would be higher than that of the cup-core.

The magnetic core structures of FIGS. 2 and 5 are ordinarily fabricated of ferrite magnetic material with a composition selected to meet the requirements at hand. Because of the small size desired of the transformer couplings, molded cores are almost a necessity. For operation up to 1 megacycle, a manganese-zinc ferrite material can be used, whereas at frequencies above 1 megacycle a nickel-zinc material is normally selected.

By way of example of the application of the invention, a reliable magnetic inductive connector to transfer electrical control signals passing between an aircraft jet engine and a mini-computer in the fuselage of such aircraft will be described in detail. Since the transformers are subjected to a temperature range of −54° C to 204° C, the cores are made of a low loss, high temperature manganese-ferrite such as Indiana General 8200 ferrite, available from the Indiana General Division of Electronic Memories & Magnetics Corp., Valpariso, Indiana. Referring to FIG. 1, the ferrite cores are in several sizes with a diameter between about 5 and 12 millimeters. The larger two-section transformer coupling 11*a* and 11*b* mounted in the center is a transducer excitation connector used to transmit power while the smaller couplings around the periphery are signal connectors which transmit at 100 kHz. Although nine different circuit connectors are shown in FIG. 1, these connectors can be programmed to transmit many more than nine different signal functions. Plug and receptacle part housing units 13*a* and 13*b* are conventional size 22 steel shells for a standard circular connector as was mentioned previously. A standard mechanical pin and socket connector with this same size shell commonly has fourteen pins and sockets for seven circuits, while the same physical size magnetic inductive connector has nine transformer couplings and at least nine basic circuits. Protective covering 20 for the exposed core and coil surfaces is, for example, the polyimide-silicone copolymer material described for use as a protective coating in U.S. Pat. No. 3,325,450 issued on June 13, 1967 to Fred F. Holub entitled "Polysiloxaneimides and Their Production", assigned to the same assignee as this invention.

Figure 6:
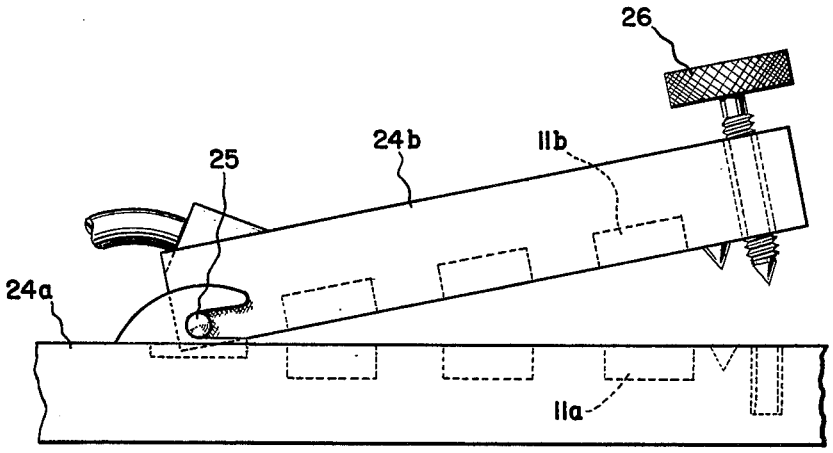
FIG. 6 is a schematic side view of another embodiment of the inductive-connector in a different packaging configuration using a hinged housing.

Another packaging configuration for the magnetic inductive connector incorporating a hinged housing is shown in FIG. 6 This embodiment has utility as a test jug and other applications. The lower fixed housing unit 24*a* and upper hinged housing unit 24*b* are metal castings with opposing holes in which are nested the matched pairs of transformer coupling sections 11*a* and 11*b*. Upper housing unit 24*b* has a transverse pin 25 about which it pivots, and there is a single screw fastening 26 at the other end. A compression gasket on housing unit 24*b* (not here shown) seals the connector when the housing units are clamped together. Such a mounting, because of its low profile, large mating surface, and small cantilevered mass would provide a high degree of resistance to vibration and mechanical shock effects.

There are many applications for the magnetic conductive connector herein described wherein reliability and/or safety are important criteria. Some of the factors relating to safety and reliability are as follows. As opposed to a standard pin and socket mechanical connector where there is often complete and abrupt loss of signal when a malfunction occurs, the magnetic inductive connector exhibits a degraded signal level, rather than complete loss of signal, due to such things as extreme misalignment or foreign matter between the parts. There are no exposed electrical contacts; and unmated connector may be safely handled even when energized. Energized connectors may be mated and unmated, intentionally or accidentally, without risk of sparking that may act as an ignition source to flammable or explosive materials. The lack of sparking also precludes the inadvertent generation of electrical interference. Accordingly, in addition to the aircraft engine control system, applications exist in other industries where reliability is a safety precaution, such as medical electronics and the chemical and food processing industries.

While the invention has been particularly shown and described with reference to several preferred embodiments thereof, it will be understood by those skilled in the art that various changes in form and details may be made therein without departing from the spirit and scope of the invention.

The invention claimed is:

1. An inductive connector comprising a pair of mating metallic housing units within each of which is mounted a metallic support plate respectively having a plurality of closely spaced recesses arranged in the same pattern, a plurality of transformer couplings each made in two separable sections which are received in opposing recesses in said support plates, each two-section transformer coupling comprising a ferrite magnetic core composed of two substantially identical, one-piece, opposing cup-type core halves each including a center member about which one transformer winding is disposed and also an outer member, said core halves when assembled having a magnetic gap therebetween with the transformer windings and center members collinear and magnetically coupled and further substantially enclosed by said outer members.

a protective coating over at least exposed areas of said core halves and transformer windings, and means for releasably clamping together said housing units with the two sections of each transformer coupling in alignment.

2. The inductive connector according to claim 1 wherein said protective coating is a polyimide-silicone copolymer material and said magnetic gap with the respective core halves assembled is less than 5 mils.

* * * * *